United States Patent [19]

Yasuda et al.

[11] 3,940,919

[45] Mar. 2, 1976

[54] ELECTRONIC WRISTWATCH WITH ELECTRONIC SOUND EMITTER DEVICE

[75] Inventors: Tetuya Yasuda, Tokyo; Makoto Yoshida, Tokorozawa; Yoshifumi Mochizuki, Kodaira; Shigeru Morokawa, Higashiyamato, all of Japan

[73] Assignee: Citizen Watch Co., Ltd., Tokyo, Japan

[22] Filed: Oct. 2, 1974

[21] Appl. No.: 511,309

[30] Foreign Application Priority Data

| | | |
|---|---|---|
| Oct. 3, 1973 | Japan | 48-115548[U] |
| Nov. 26, 1973 | Japan | 48-132381 |
| May 23, 1974 | Japan | 49-59209[U] |

[52] U.S. Cl. ..... 58/38 R; 58/19 R

[51] Int. Cl.[2] ..... G04C 21/16; G04C 21/00

[58] Field of Search ..... 58/19, 38

[56] References Cited

UNITED STATES PATENTS

| | | | |
|---|---|---|---|
| 3,759,029 | 9/1973 | Komaki | 58/38 |
| 3,788,060 | 1/1974 | Kawamura | 58/38 |
| 3,834,153 | 9/1974 | Yoda et al. | 58/38 |

*Primary Examiner*—Edith Simmons Jackmon

*Attorney, Agent, or Firm*—Spensley, Horn and Lubitz

[57] ABSTRACT

An electronic wristwatch with an electronic sound emitter device which provides greatly improved efficiency in the quality and quantity of the sound emitted with a minimum number of elements. The results, in general, are obtained by arranging the elements in such a manner that a suitable signal is presented to the sound emitter driving device upon the coincidence of a preset time and the time given by a time display device.

8 Claims, 9 Drawing Figures

Fig. 5
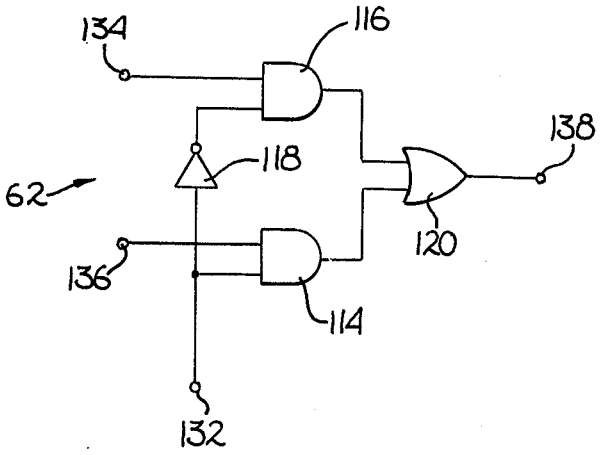
Fig. 8
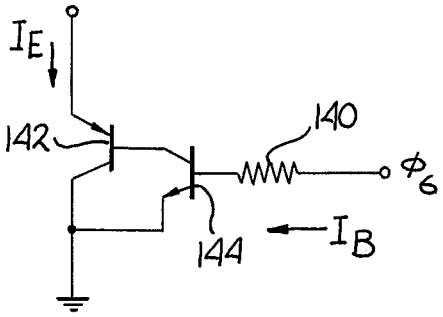
Fig. 6
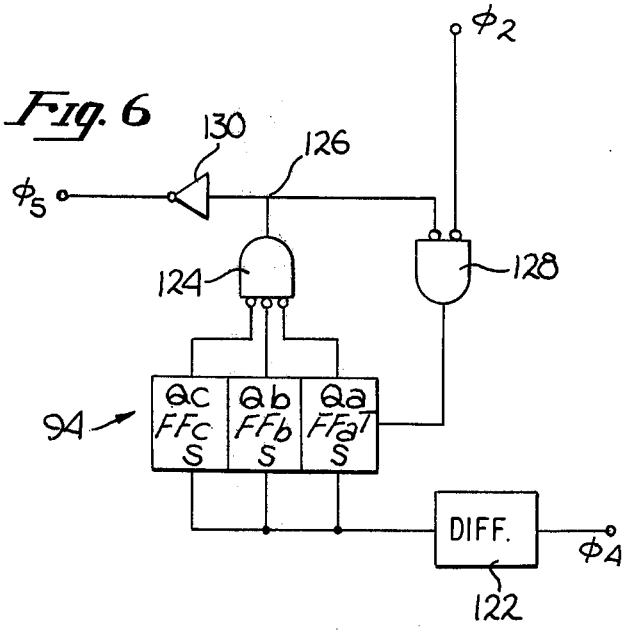
Fig. 9
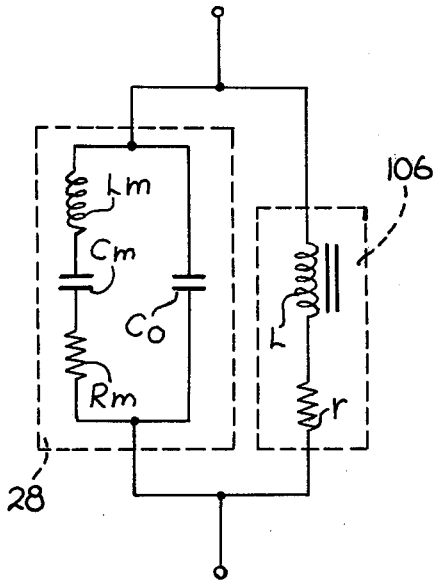
| | Qa | Qb | Qc |
|---|---|---|---|
| $T_0$ | 1 | 1 | 1 |
| $T_1$ | 0 | 1 | 1 |
| $T_2$ | 1 | 0 | 1 |
| $T_3$ | 0 | 0 | 1 |
| $T_4$ | 1 | 1 | 0 |
| $T_5$ | 0 | 1 | 0 |
| $T_6$ | 1 | 0 | 0 |
| $T_7$ | 0 | 0 | 0 |
Fig. 7

ELECTRONIC WRISTWATCH WITH ELECTRONIC SOUND EMITTER DEVICE

BACKGROUND OF THE INVENTION

1. Field of the Invention

This invention relates to an electronic wristwatch, and more particularly, to a crystal wristwatch with an electronic sound emitter device which vibrates a small size piezo-electric sound converter element by a signal from a frequency standard source of the wristwatch.

2. Prior Art

Prior art devices disclose a wristwatch with an electronic sound emitter device which requires a high voltage in order to vibrate a piezo-electric sound converter element. The maximum voltage which can be obtained from a small size battery suitable for placing in a wristwatch is approximately three volts. Usually, in order to increase voltage requirements, a transformer is used. However, it has been very difficult to produce a transformer small enough to be conveniently installed in a wristwatch. Another prior art method of operating a piezo-electric sound converter element is to use a relaxation oscillator or a blocking oscillator. Both the blocking oscillator and relaxation oscillator dissipate a considerable amount of power, and have a physical size not suitable for a wristwatch. Hence production of an electronic wristwatch with an electronic sound emitter device has not been achieved.

Recently a mechanical wristwatch combined with an electronic sound emitting divce has been manufactured. However, it lacks a compact arrangement whereby the sound emitting device and the mechanical part could share the electronic circuit. To the contrary the electronic device is merely placed physically into the mechanical watch. Consequently it does not appear as a welldesigned wristwatch.

In recent years, a crystal wristwatch with a small sized, low power C-MOS (Complimentary Metal Oxide Semiconductor) circuit has been on the market, and since that time production of crystal wristwatches with piezo-electric sound emitter device has been desired.

In the case of the above-mentioned wristwatch, the sound emitter driving circuit comprising C-MOS transistors are used to set a low frequency signal by dividing the oscillator signal from the crystal oscillator by the use of multi-stage frequency divider. However, one of the difficulties encountered in this crystal wristwatch was to emit alarm sound loud enough to be heard by human ear.

Furthermore, the mechanical resonance frequency of said piezo-electric sound converter element is limited by the size of the wristwatch and its operational range of the frequency will be from 1K Hz to 8K Hz. In a case where the series divided frequency signal obtained from the multi-stage frequency divider is directly used, the frequency of the most effective alarm sound to the human ear is below 1K Hz. Therefore, if the frequency of the sound from 1K Hz to 8K Hz of said wristwatch is used, the alarm sound of said wristwatch can hardly be heard by the human ear except at its beginning.

BRIEF SUMMARY OF THE INVENTION

The primary object of this invention is to provide an electronic wristwatch with an electronic sound emitter device comprising a moderately high frequency standard oscillator, preferably a crystal oscillator, as a frequency standard, an oscillating circuit means for vibrating the standard oscillator, a multi-stage frequency divider for reducing the frequency of the signal from the oscillator, a time count means driven by the signal from the multi-stage frequency divider to electronically determine the time, a time display means to display the time content of said time count means, a control means to be controlled externally for controlling the sound emitting time to be stored in the memory means, a switch mechanism which is coupled to said control means for operating the control means, a memory means for storing the sound emitting time by the use of said switch mechanism, a detecting means to detect the time matching between the presetting memory content of said memory means and the content of said time count means, a gating circuit which controls (turn on/-off) the signal from a stage of said multi-stage frequency divider by the use of the signal from said detecting means, a sound emitter driving circuit having at least one bipolar transistor, a booster coil, a piezo-electric sound converter element, said piezo-electric sound converter element and said booster coil are connected in parallel, one end of said booster coil is coupled to the input of said sound emitter driving circuit, the other end of said booster coil is coupled to a power terminal, and upon the correspondence of said time content to said memory content, said detecting means and said gating circuit control the signal from a stage of said multi-stage frequency divider to the input of said sound emitter driving circuit, thereby vibrating said piezo-electric sound converter element.

Another object of this invention is to provide an electronic wristwatch with an electronic sound emitter device having a high effectiveness of alarm sound by choosing the singing signal and intermittent signal of said piezo-electric sound converter element from a group of frequency of $2^n$ obtained from said multi-stage frequency divider or said time count means.

A further object of this invention is to provide an electronic wristwatch with an electronic sound emitter device, wherein the piezo-electric sound converter element is vibrated at the matching resonance frequency of both the mechanical resonance frequency of said piezo-electric sound converter element and an electric resonance frequency determined by said booster coil and said piezo-electric sound converter element, wherein the frequency of said vibration signal is to be obtained from multiplying or dividing said resonance frequency by an integer.

BRIEF DESCRIPTION OF THE DRAWINGS

FIG. 5 is a logic circuit diagram of the switching circuit.

FIG. 6 is a logic circuit diagram of the structure of the timer circuit 94 in detail.

FIG. 7 is a truth table showing the operation of the timer circuit in FIG. 6.

FIG. 8 is a schematic diagram of another embodiment showing a sound emitter driving circuit.

FIG. 9 is a schematic diagram of an equivalent circuit of the booster coil 106 and piezo-electric sound converter element 28.

DETAILED DESCRIPTION OF THE PREFERRED EMBODIMENT

Figure 1:
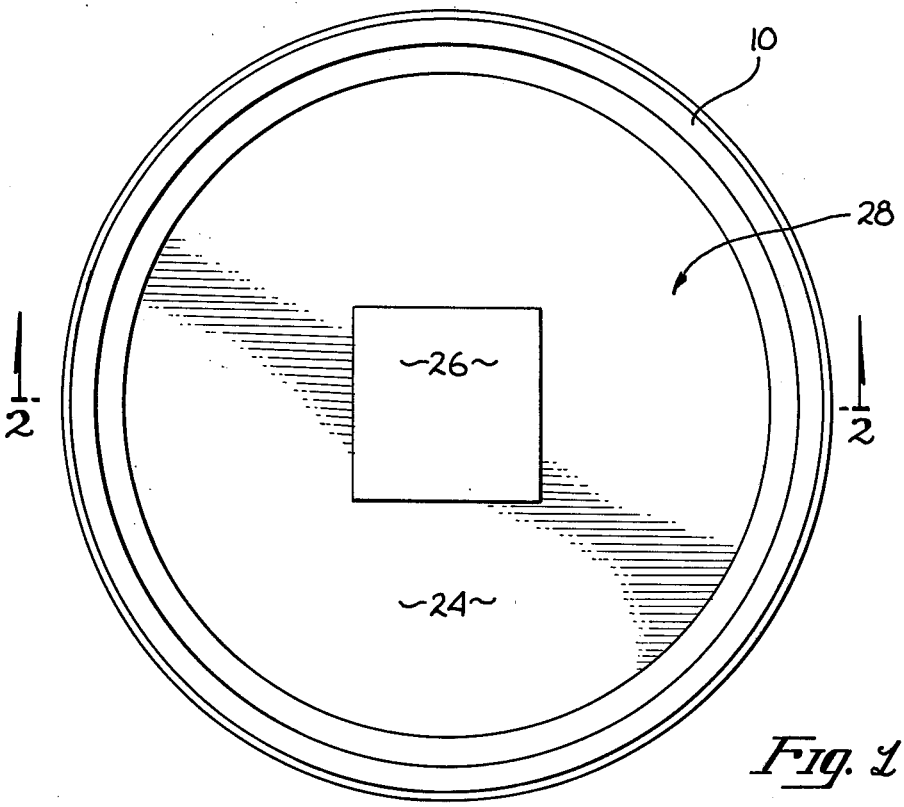
FIG. 1 is a plan view of a piezo-electric sound converter element attached to the back cover of a crystal wristwatch with an electronic sound emitter device described as an embodiment of this invention.

Referring to FIG. 1 which is a plan view of a piezo-electric sound converter element, a dish-shaped oscillation membrane 24 made of titanium materials is attached to the inner brim of back cover 10 of the wristwatch.

Using a conductive adhesive agent, a piezo-electric element 26 is adhered to the middle portion of said oscillation membrane 24. The material $BaTiO_3$ or Pb $(Ti—Zr)O_3$ is used as a piezo-electric element. The mechanical resonance frequency (*fm*) of the piezo-electric sound converter element 28 comprising the oscillation membrane 24 and piezo-electric element 26 depends largely upon the size of the piezo-electric sound converter element 28. In the preferred embodiment the mechanical resonance frequency (*fm*) of 2,000 Hz was obtained empirically by setting the following parameters, wherein the diameter of the oscillation membrane 24 is 28 mm with a thickness of 0.1 mm, and one side of the perfect-squared piezo-electric element 26 is 8 mm with a thickness of 0.14 mm. In this case the device (piezo-electric sound converter element) is adhered to the back cover provided in a limited space of the inner wall of the watch case so that no space will be wasted within the watch.

The above-mentioned mechanical resonance frequency (*fm*) is a sound frequency which can easily be heard by human ear. For example, if the size of the piezo-electric sound converter element mounted on the watch is smaller than one described above, the mechanical resonance frequency is increased to above 5,000 Hz and it can hardly be heard by human ear. At the same time, if the frequency is higher than 5,000 Hz, it consumes more power in order to vibrate the piezo-electric sound converter element so fast.

On the other hand, if the size of the piezo-electric sound converter element is larger than one described above, then it is difficult for it to be installed in the limited space of the watch even though the mechanical resonance frequency goes down to below 1,000 Hz which has more effective alarm sound to human ear. Thus it has been experimentally discovered that the most suitable mechanical resonance frequency for the piezo-electric sound converter element for a wristwatch size is around 2,000 Hz (e.g., broadly the range of approximately 1,000 – 5,000 Hz).

Figure 2:
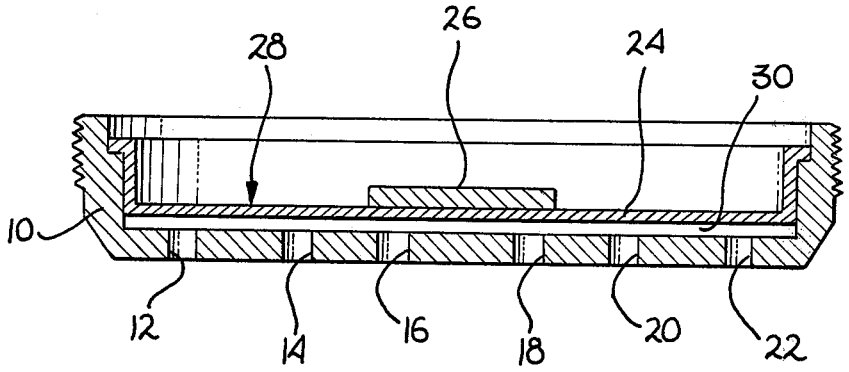
FIG. 2 is a sectional view along line II—II′ of FIG. 1.

Referring to FIG. 2, apertures 12, 14, 16, 18, 20, and 22 are provided on the bottom part of back cover 10 in order to transfer and emit the alarm sound from the vibrating piezo-electric sound converter element to the outside. A space 30 of 0.1 mm is provided between the inner bottom of back cover 10 and oscillation membrane 24 in order to keep enough space for the amplitude of oscillation (below 0.02 mm) of oscillation membrane 24 which is vibrated by piezo-electric sound converter element 28. The electric vibration signal to the piezo-electric sound converter element is transmitted by the known joint spring connected between the back cover and the watch movement.

Figure 3:
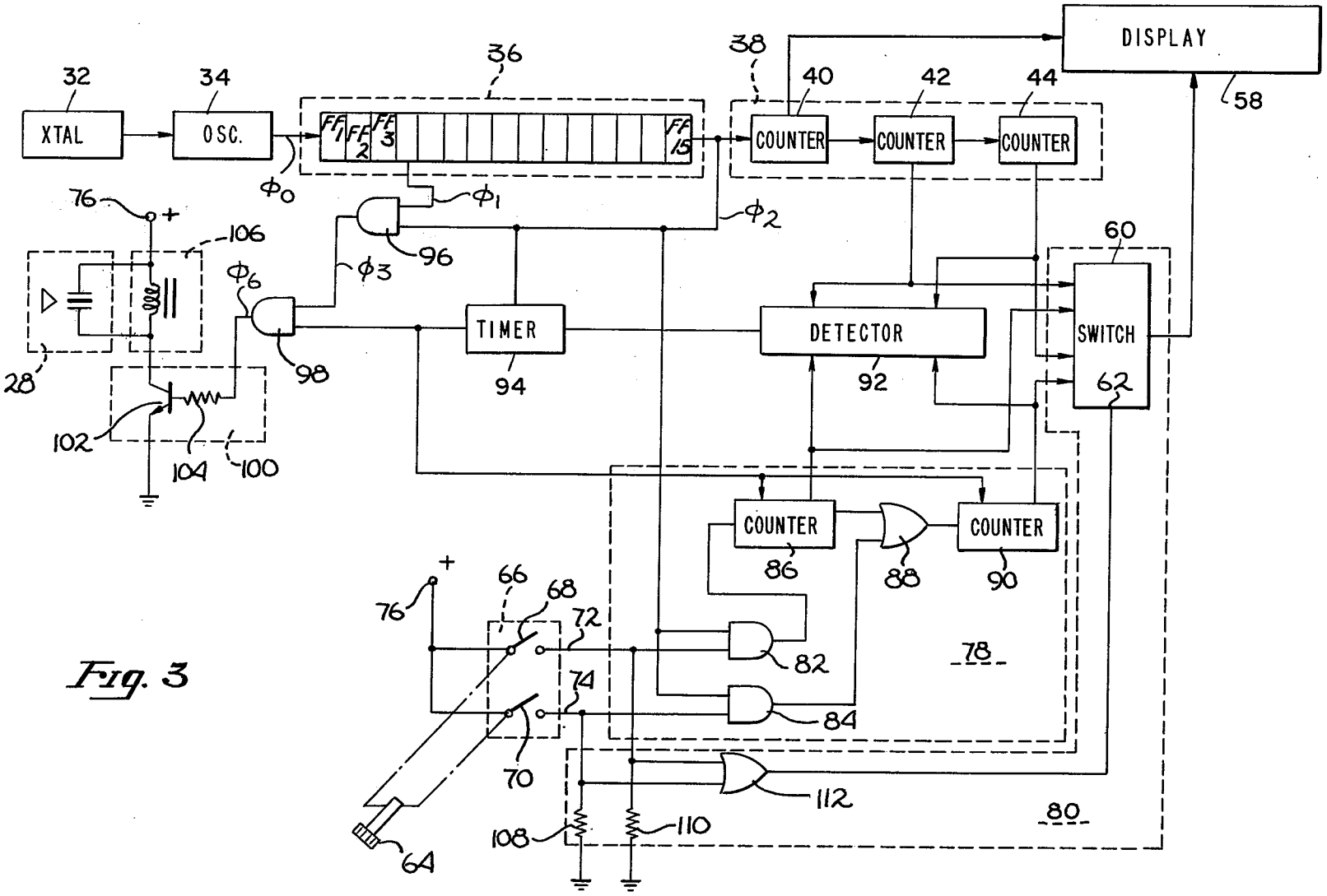
FIG. 3 is a block diagram showing the structure of the crystal wristwatch with an electronic sound emitter device described in the same embodiment.

Referring to FIG. 3 which shows a block diagram of the crystal wristwatch, a high-frequency standard oscillator 32 is used as a frequency standard. In the preferred embodiment, a 32768 Hz crystal oscillator is used as standard oscillator 32. Multi-stage frequency divider 36 is formed by cascading 15 dividers or 15 flip-flops; that is, dividing the oscillator signal 32768 Hz from the oscillator by two 15 times so that the low frequency of 1 Hz is obtained at the last stage of frequency divider 36. Numeral 34 designates an oscillator circuit to oscillate crystal oscillator 32 which is well known to the art.

Numeral 38 designates a time count means to count divided frequencies $\phi_2$ from the multi-stage frequency divider, which includes a 10 × 6 counter circuit 40 comprising a mode-10 counter circuit to count the ones digit of seconds and a mode-6 counter circuit to count the tens digit of seconds. A 10 × 6 counter circuit 42 comprising a mode-10 counter circuit to count the ones digit of minutes and a mode-6 counter circuit to count the tens digit of minutes is connected to 10 × 6 counter circuit 40. A 10 × 2 counter circuit 44 consisting of a mode-10 counter circuit to count the ones digit of hours and a mode-2 counter circuit to count the tens digit of hours is connected to the 10 × 6 counter ciircuit 42. The counter content of 10 × 6 counter circuit 40 (seconds counter) is connected to a decoder and display driver circuit and time display means 58 which contains an electronic light display means such as liquid crystal or well-known L.E.D. (Light Emitter Diode) display means in order to display seconds. Such decoders, driving circuits, and displays are well known in the art. At normal states, using the display switch circuit 60 the time display is done by using display means 58 to display minutes and hours chosen from the time contents of 10 × 6 counter circuit 42 and 10 × 2 counter circuit 44.

An operational mechanism 64 to be operated from outside of the watch such as a winding crown is linked or coupled to switching means 66 comprising switches 68 and 70 which are at neutral positions of the operational mechanism and are normally open. By turning the operational mechanism clockwise or counter-clockwise, both these switches can be operated; that is, to close switch 68 the operational mechanism is turned counter-clockwise and if it is turned clockwise, switch 70 will be closed. One end of switch 68 and one end of switch 70 are tied to the positive terminal 76 of a voltage source. Also, lead 72 from switch 68 and lead 74 from switch 70 are connected to both memory means 78 and display switching means 80.

Memory means 78 comprises two AND gates 82 and 84, a 10 × 6 counter circuit 86, an OR gate 88, and a 10 × 2 counter 90. Memory means 78 counts the signal $\phi_2$ from said multi-stage frequency divider during the operational period of the operational mechanism and setsor stores the memory content, which is the sound emitting time, in 10 × 6 counter circuit 86 and 10 × 2 counter circuit 90.

Figure 4:
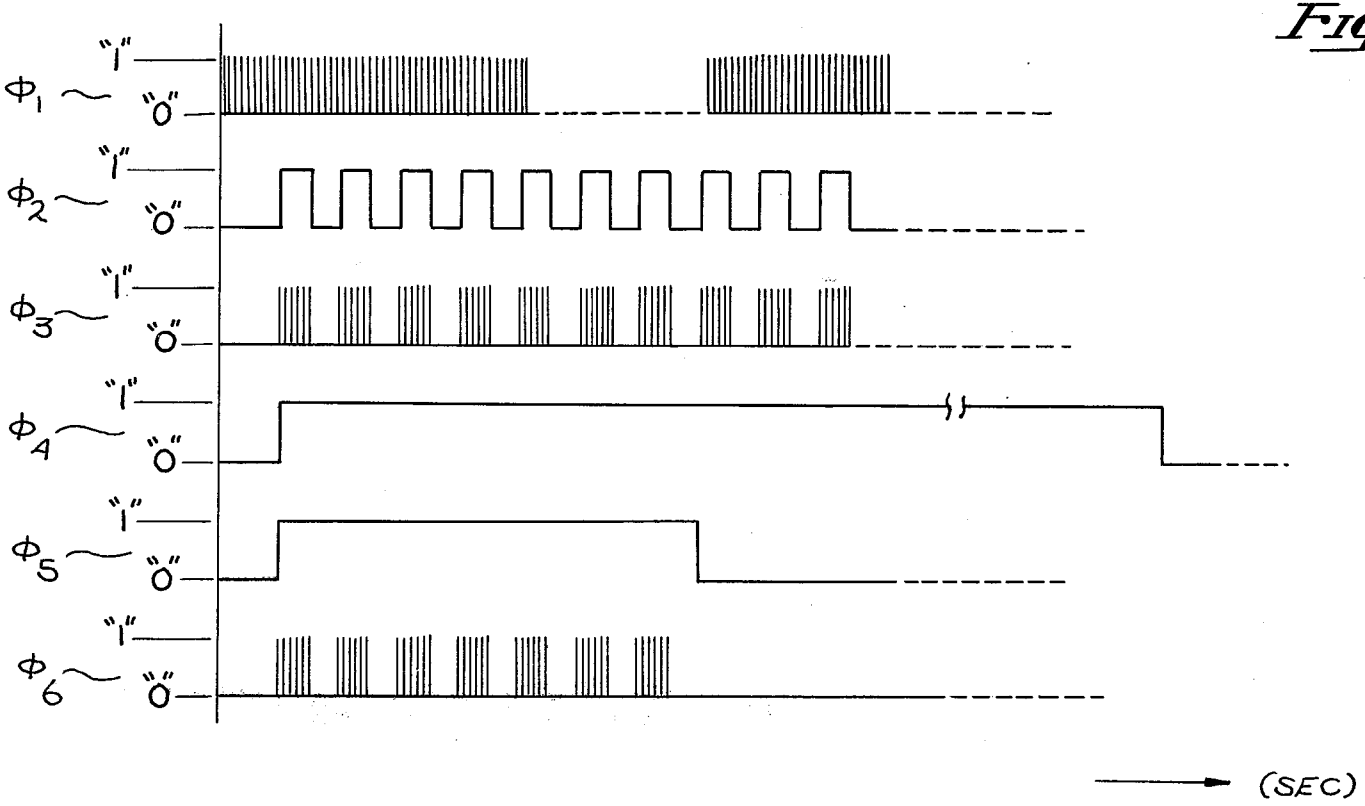
FIG. 4 is a timing diagram showing the timing details of the timer circuit shown in FIG. 3.

Detecting means (comparator) 92 is formed by the combinations of known AND gates to which each bit from each counter 42, 44, 86, and 90 are coupled. Detecting means 92 then compares the time content of said 10 × 6 counter circuit 42 with the memory content of said 10 × 6 counter circuit 86, and similarly compares the time content of said 10 × 2 counter circuit 44 with the memory content of 10 × 2 counter circuit 90. Therefore, when the time content of timer circuits 42 and 44 match with the memory content of counter circuits 86 and 90, detecting means 24 sends out signal $\phi_4$ which is a one-minute wide pulse or signal of logic level "1". From here the wave forms of FIG. 4 are explained at the same time.

Timer circuit 94 is connected to detecting means 92 and when its input receives the signal $\phi_4$ from detecting means 92 it sends out signal $\phi_5$ which is a seven-second wide pulse of logic level "1". This signal $\phi_5$ connected to reset terminal R1 of 10 × 6 counter circuit 86 and reset terminal R2 of 10 × 2 counter circuit 90, clears the memory contents.

Numerals 96 and 98 designate AND gate circuits. One of the inputs of AND gate 96 receives signal $\phi_1$ (e.g., 2048 Hz) from F—F of the multi-stage frequency divider and another input of AND gates 96 receives the signal $\phi_2$ (e.g., 1 Hz) from F—$F_{15}$ of the frequency divider, and then AND gate 96 generates signal $\phi_3$.

Two inputs of AND gate 98 are connected to signal $\phi_3$ from AND gate 96 and to signal $\phi_5$ from timer circuit 94 and AND gate 98 generates signal $\phi_6$. This signal $\phi_6$, which comes from the output of AND gate 98, is connected to the input of the sound emitter driving circuit 100.

Numeral 106 designates booster coil, one end of which is connected to the output of the sound emitter driving circuit 100 and the other end of which is connected to positive terminal 76 of the voltage source. Also, this booster coil 106 is connected in parallel to piezo-electric sound converter element 28 which is vibrated by oscillation signal $\phi_6$.

Now, the numeral values of signal $\phi_1$ and intermittent signal $\phi_2$ in this embodiment will be discussed. Both signal $\phi_1$ and signal $\phi_2$ are chosen from frequency groups of $2^n$ ($n$=0, 1, 2, . . . , $n$) of said multi-stage frequency divider 36 and generates signal $\phi_3$. If a signal of 512 Hz $\phi_3$ is chosen, it will be outside of the operational range of said piezo-electric sound converter element and it is very difficult to produce enough output of sound. Therefore, a frequency range of 1,000 to 8,000 Hz is chosen, but if the frequency exceeds 5,000 Hz, then it requires more electric power for oscillations and also it can hardly be heard by human ear because of the high frequency. Also, if the frequency of intermittent signal $\phi_2$ is chosen at a few tenths of 1 Hz, the effectiveness of the alarm sound is decreased because of long off-periods. On the other hand, if the frequency is too short, it also decreases the effectiveness of the alarm sound.

As described above, as far as signal $\phi_3$ in this embodiment is concerned, the most effective alarm sound can be obtained from combinations of frequency ranges of 0.5 Hz to 2 Hz for signal $\phi_2$ and 1,000 Hz to 5,000 Hz for signal $\phi_1$, centered at 2048 Hz for signal $\phi_1$ and 1 Hz for signal $\phi_2$. Actually, it is advantageous in designing the circuit to use frequency divided signals from the oscillator circuit which is the frequency standard of an electronic wristwatch as signal $\phi_1$ and signal $\phi_2$, that is, to choose 1024 Hz, 2048 Hz or 4086 Hz for signal $\phi_1$ and 0.5 Hz, 1 Hz, or 2 Hz for signal $\phi_2$. Then any combinations of above frequencies can be picked. In this way, it is not necessary to provide a relaxation oscillator or a blocking oscillator which are used to operate the piezo-electric sound converter element.

The display switch means is explained as follows: Lead 72 from switch 68 is connected to one of two inputs of OR gate 112 and lead 74 from switch 70 is connected to the other input of OR gate 112, each of the input ends being grounded with resistor 108 and resistor 110, respectively, having the resistance of 10 MΩ. Thus, if either one of the switches 68 or 70 is closed, the output of OR gate 112 goes to logic level "1". This is the operational state while the sound emitting time is being set into memory means 78. The output of OR gate 112 is connected to display switch means 60. The basic circuit of display switch means is shown in FIG. 5.

Referring to FIG. 5, a well-known switch circuit 62, comprising two AND gates 114 and 116, inverter 118, OR gate 120 and terminal 132, is connected to the output of said OR gate 112. Terminal 134 is connected in such a way that one bit signal, which is part of the time content of said counter circuit 42 or 44, can be obtained, and terminal 136 is connected so as to give a one-bit signal corresponding to the one-bit signal which is a part of said time content, which in turn is a part of the memory content of said counter circuit 86 or 90. Thus, switch circuit 60 shown in FIG. 3 includes 12 combinations of display switch circuit 62 combined with seven bits of counter circuit 42 and five bits of counter circuit 44.

Twelve terminals 138 are connected to display means 58 and when the output of OR gate 112 is at logic level "1", the memory contents of counter circuits 86 and 90 will be displayed on display means 58 and when the output of OR gate 112 is at logic level "0", the time contents of counter circuits 42 and 44 will be displayed. Thus, the memory setting of sound emitting time operated by operational mechanism 64 can be monitored by the memory content shown by display means 58 while the memory setting is being done. In this way it will be assured that the memory setting is done with no errors or false signals.

Referring to FIGS. 6 and 7, circuit descriptions and operations of timer circuit 94 are now explained. In FIG. 6, a known logic differentiator circuit 122 differentiates signal $\phi_4$ at the beginning of a rise to logic level "1" and makes differentiated narrow pulse signals which go to each terminal of F-F$a$, F-F$b$, F-F$c$. Having reset each F-F$s$ by differentiated pulses, output logic levels of each F-F$s$ (Q$a$), (Q$b$), (Q$c$) are shown on the truth table (T$o$) in FIG. 7. Therefore, the logic level of the output of gate 124 goes to "0" since the inputs of gate 124 are connected to Q$a$, Q$b$, Q$c$, respectively.

Numeral 130 designates an inverter and the output of inverter 130, signal $\phi_5$, goes to logic level "1" accordingly.

Numeral 128 designates a gate circuit and one of the inputs of gate 128 is connected to said output terminal 126 and the other input of gate 128 is connected to signal $\phi_2$, 1 Hz signal.

Output of gate 128 is connected to input of F-F$a$ and it counts signal $\phi_2$, starting from (T$o$) state and ending at ($T_7$) state which is Q$a$ = "0", Q$b$ = "0", Q$c$ = "0". During this counting period, since signal ($\phi_2$) is 1 Hz, it counts 7 seconds, and brings signal $\phi_5$ to logic level "0" again. This ($T_7$) state will be maintained until next signal $\phi_4$ comes in.

Thus, signal $\phi_3$ and signal $\phi_5$ enable the limiting of the alarm signal to oscillation signal $\phi_6$, which is generated by AND gate 98, to seven seconds and this period, seven seconds, is short enough to save electric power consumption that is needed to operate sound emitter driving circuit 106 and piezo-electric sound converter element 28, etc. which all occurs after signal $\phi_6$ is generated.

In FIG. 3, sound emitter driving circuit 100 consists of NPN type bipolar transistor 102 and resistor 104. The oscillator signal $\phi_6$ from gate circuit 98 go through resistor 104 (e.g., 40 KΩ), and is fed to the base of bipolar transistor 102 to control the ON and OFF switch of the bipolar transistor. Reasons for using a bipolar transistor are as follows: First, when the bipolar transistor is in an ON state and is saturated, the voltage drop between the collector and emitter is extremely small so that enough voltage from a 1.5-volt battery, which is small enough to be installed in a wristwatch, can be supplied efficiently to piezo-electric sound converter element 28 and booster coil 106. On the other hand, in case an M.O.S. transistor is used, there is some resistance 1K – 2K, so-called channel resistance, between the drain and source of the transistor when it is in the "ON" state. Therefore, the voltage drop is relatively large and it is impossible to vibrate the piezo-electric sound converter element hard enough to emit an alarm sound. Secondly, an MOS transistor is easily burned or damaged by a high voltage from booster coil 106 while a bipolar transistor is much more durable with respect to a high voltage. Therefore, it is suitable to use bipolar transistors for the sound emitter driving circuit.

In FIG. 8, numeral 140 designates a 100 KΩ resistor, numeral 142 designates an NPN type bipolar transistor, and numeral 144 designates a PNP type bipolar transistor. By combining PNP type transistor and NPN type transistor, a Darlington circuit is formed to gain a large emitter current $I_E$ from a small base current $I_B$. Suppose the current gain of transistor 142 is $hFE_1$ and the current gain of transistor 144 is $hFE_2$, then emitter current $I_E$ will be $I_E = hFE_1 \times (1 + hFE_2) \times I_B$. Therefore, the sound emitter driving circuit can be controlled ON and OFF by the small base current ($I_B$), thus there is no need to flow much current from AND gate 98 formed by C-MOS devices. In this way it is much easier to join AND gate 98 with the sound emitter driving circuit.

An equivalent circuit is shown in FIG. 9, in which booster coil 106 and piezo-electric sound converter element 28 are connected in parallel. Cm and Co are capacitors and Rm is resistor.

In FIG. 9 the equivalent circuit (mechanical value is replaced by electrical value in order to simplify calculation) for piezo-electric sound converter element 28 comprises inductor Lm, capacitors Cm and Co, and resistor Rm, and its mechanical resonance frequency is primarily determined by the formula:

$$fm \approx \frac{1}{2\pi \sqrt{Lm\ Cm}}$$

The equivalent circuit for booster coil 106 consists of an inductor (L) and resistor (R) and by connecting booster coil 106 and piezo-electric sound converter element in parallel, the electric resonance frequency is primarily determined by the formula:

$$fo \approx \frac{1}{2\pi \sqrt{L\ Co}}$$

In order to vibrate the piezo-electric sound converter element efficiently, the inductance L of booster coil 106 should be increased so that output voltage ($e$) from booster coil 106 is also increased.

$$e = -L\ (di/dt)$$

Thus a very high voltage can be obtained. But the maximum value that can be obtained from the booster coil wound on a ferrite core, which is small enough to be installed in the wristwatch, is 0.1 (H). Therefore, the following methods can be used to vibrate efficiently.

1. By matching the electric resonance frequency $fo$ (which is formed by booster coil 106 and piezo-electric sound converter element 28) and the mechanical resonance frequency $fm$ of piezo-electric sound converter element, the energy loss caused by inserting the booster coil can be decreased; that is, to bring the resonance impedance of the parallel resonance circuit larger than the D.C. resistance (R) and since $fo = fm$ is held (matching the electric resonance frequency with the mechanical resonance frequency), more energy will be supplied to the piezo-electric sound converter element to vibrate efficiently.

2. The frequency of signal $\phi_2$, which is base signal for oscillation signal $\phi_6$, can be matched with the mechanical resonance frequency $fm$ of piezo-electric sound converter element 28 or signal $\phi_2$ can be matched with the mechanical resonance frequency $fm$ multiplied by the numbers such as $2^n$ ($n = 1,2,3 \ldots, n$) or ½, ⅓, ¼, . . . etc. By applying the methods described above satisfactorily to the design, an effective alarm sound can be obtained.

Experiments have proven that the power consumption which directly relates to the efficiency of the system is very small, less than 10 mw, and still it is enough to operate the system. In one embodiment, inductance L of booster coil 106 is approximately 50 mH and the physical size of booster coil 106 is small enough to be installed into the space of the wristwatch.

We claim:

1. An electronic wristwatch with an elctronic sound emitter device comprising an oscillator means for providing a frequency standard, said means providing a repetitive signal, a multi-stage frequency divider for reducing the frequency of the signal from the oscillator means, a time count means for determining the time, said means driven by a signal from the multi-stage frequency divider, a time display means to display the time content of said time count means, a control means to be controlled externally for controlling the setting of a sound emitting time in a memory means, a switch mechanism which is coupled to said control means to operate said control means, a memory means for storing the sound emitting time when said switch mechanism is activated, a detecting means for detecting the time matching between the setting of said memory means and the content of said time count means and thereupon providing a signal, a logic circuit means for providing a signal determined by said multi-stage frequency divider and said detecting means, said logic circuit means coupled to said detecting means and said multi-stage frequency divider, a sound emitter driving circuit coupled to said logic circuit means, a booster coil, a piezo-electric sound converter element, said piezo-electric sound converter element and said booster coils are connected in parallel, one end of said booster coil is coupled to the output end of said sound emitter driving circuit, the other end of said booster coil is coupled to a power terminal, whereby upon the correspondence of said time content with said memory content, said detecting means provides a signal to operate said logic circuit means to provide a signal from said multi-stage frequency divider to the input of said sound emitter driving circuit thereby oscillating said piezo-electric sound converter element.

2. An electronic wristwatch with an electronic sound emitter device of claim 1 wherein said sound emitter driving circuit has at least one bipolar transistor.

3. An electronic writstwatch with an electronic sound emitter device according to claim 1, wherein the frequency of the signal provided from said multi-stage frequency divider to said piezo-electric sound converter element is selected from the group comprising the following frequencies, 1024 Hz, 2048 Hz, and 4096 Hz, and the logic circuit means and the detecting means cooperate such that said signal from said divider intermittently operates said piezo-electric sound converter element at a rate selected from the group comprising the following frequencies, 0.5 Hz, 1 Hz, and 2 Hz.

4. An electronic wristwatch with an electronic sound emitter device according to claim 1, wherein said electronic wristwatch has a display switch means in order to selectively display the contents of said time count means and said memory means.

5. An electronic wristwatch with an electronic sound emitter device according to claim 1, wherein a timer circuit is provided between said detecting means and said logic circuit means.

6. An electronic wristwatch with an electronic sound emitter device according to claim 1, wherein said sound emitter driving circuit is a Darlington circuit.

7. An electronic wristwatch with an electronic sound emitter device according to claim 1, wherein said piezo-electric sound converter element is vibrated at the matching resonance frequency of both the mechanical resonance frequency of said piezo-electric sound converter element and an electric resonance frequency, determined by said booster coil and said piezo-electric sound converter element.

8. An electronic wristwatch with an electronic sound emitter device according to claim 7, wherein the frequency of said vibration signal is to be obtained from multiplying or dividing said resonance frequency by an integer.

* * * * *